US010065128B2

(12) United States Patent
Schildknecht Hoè et al.

(10) Patent No.: US 10,065,128 B2
(45) Date of Patent: Sep. 4, 2018

(54) TOY BUILDING SET

(71) Applicant: LEGO A/S, Billund (DK)

(72) Inventors: Mikkel Schildknecht Hoè, Juelsminde (DK); Jan Ryaa, Billund (DK)

(73) Assignee: LEGO A/S (DK)

( * ) Notice: Subject to any disclaimer, the term of this patent is extended or adjusted under 35 U.S.C. 154(b) by 0 days.

(21) Appl. No.: 14/427,492

(22) PCT Filed: Sep. 10, 2013

(86) PCT No.: PCT/DK2013/050288
§ 371 (c)(1),
(2) Date: Mar. 11, 2015

(87) PCT Pub. No.: WO2014/040602
PCT Pub. Date: Mar. 20, 2014

(65) Prior Publication Data

US 2015/0224416 A1 Aug. 13, 2015

(30) Foreign Application Priority Data

Sep. 11, 2012 (DK) ..... 2012 70554

(51) Int. Cl.
*A63H 33/04* (2006.01)
*A63H 33/10* (2006.01)
(Continued)

(52) U.S. Cl.
CPC ..... *A63H 33/106* (2013.01); *A63H 17/06* (2013.01); *A63H 33/04* (2013.01); *A63H 33/042* (2013.01);
(Continued)

(58) Field of Classification Search
CPC ..... A63H 33/04; A63H 33/06; A63H 33/062; A63H 33/065; A63H 33/067; A63H 33/08;
(Continued)

(56) References Cited

U.S. PATENT DOCUMENTS 4,114,307 A * 9/1978 Liebeskind ..... A63H 33/062 428/53
5,172,534 A * 12/1992 Milner ..... A63H 33/042 446/104
(Continued)

FOREIGN PATENT DOCUMENTS

CN 1208358 A 2/1999
CN 1323238 A 11/2001
(Continued)

OTHER PUBLICATIONS

International Search Report received in related international application No. PCT/DK2013/050288, dated Nov. 20, 2013.
(Continued)

*Primary Examiner* — Gene Kim
*Assistant Examiner* — Alyssa Hylinski
(74) *Attorney, Agent, or Firm* — Day Pitney LLP

(57) ABSTRACT

A toy building set comprising a first and a second building element, wherein the first building element is provided with a first type of hinge part, and the second building element is provided with a second type of hinge part, wherein the first and second types of hinge parts are configured complementarily in such a way that the hinge parts on the first and second elements can be releasably interconnected to the effect that they form a hinged joint between the building elements, whereby the building elements can be mutually rotated about the common hinge axis defined at the hinged joint, wherein the toy building set further comprises at least
(Continued)

one third building element comprising a third type of hinge part which is complementarily configured in such a way that the hinge parts on the first and third elements can be interconnected, whereby both the second type and the third type of hinge parts are provided with a toothing.

8 Claims, 4 Drawing Sheets

(51) Int. Cl.
*A63H 17/06* (2006.01)
*A63H 33/06* (2006.01)
*A63H 33/08* (2006.01)

(52) U.S. Cl.
CPC ..... *A63H 33/065* (2013.01); *A63H 33/086* (2013.01)

(58) Field of Classification Search
CPC .... A63H 33/086; A63H 33/10; A63H 33/106; A63H 33/042
See application file for complete search history.

(56) References Cited

U.S. PATENT DOCUMENTS 5,265,969 A * 11/1993 Chuang ..... A45B 17/00 16/329
5,304,086 A * 4/1994 Bolli ..... A63H 33/042 446/104
5,454,745 A * 10/1995 Spielberger ..... A63H 33/00 446/227
5,582,488 A * 12/1996 Dudley ..... A63H 33/042 16/367
5,897,417 A 4/1999 Grey
6,155,620 A * 12/2000 Armstrong ..... A01B 1/00 15/105
6,447,358 B1 * 9/2002 Mikkelsen ..... A63H 33/042 16/260
6,508,689 B1 * 1/2003 Mikkelsen ..... A63H 33/042 446/108
2011/0021107 A1 * 1/2011 Nag ..... A63H 33/042 446/91

FOREIGN PATENT DOCUMENTS

| | | | |
|---|---|---|---|
| CN | 202342897 | U | 7/2012 |
| DK | 174710 | B1 | 9/2003 |
| GB | 2288551 | A | 10/1995 |
| JP | 3665791 | B2 | 6/2005 |
| JP | 4402838 | B2 | 1/2010 |
| JP | 2013544556 | A | 12/2013 |
| TW | M415736 | U1 | 11/2011 |
| WO | 1997/021475 | A1 | 6/1997 |
| WO | 2012/052025 | A1 | 4/2012 |
| WO | 2012/089218 | A1 | 7/2012 |

OTHER PUBLICATIONS

Notification of Transmittal and International Report on Patentability in related international application No. PCT/DK2013/050288, dated Aug. 27, 2014.
Written Opinion of the International Searching Authority in related international application No. PCT/DK2013/050288.
International-Type Search Report in related Danish application No. DK 0554/2012, completed on Feb. 25, 2013.
Priority Search Report in Danish application No. PA 2012 70554, dated Apr. 22, 2013.
First Office Action issued in related Chinese Patent Application No. 201380051465.3, dated Nov. 27, 2015. (English translation).
JPO's Notification of Reasons for Refusal issued in corresponding Japanese application No. 2015-531467, dated Aug. 9, 2017. (with English Translation).

* cited by examiner

TOY BUILDING SET

CROSS-REFERENCE TO RELATED APPLICATIONS

This application is a U.S. National Stage of International Application No. PCT/DK2013/050288, filed on 10 Sep. 2013 and published on 20 Mar. 2014, as WO 2014/040602 A1, which claims the benefit of priority to Danish Patent Application No. PA 2012 70554, filed on 11 Sep. 2012.

The present invention relates to a toy building set comprising a first and a second building element, wherein the first building element is provided with a first type of hinge part, and the second building element is provided with a second type of hinge part, wherein the first and second types of hinge parts are configured complementarily in such a way that the hinge parts on the first and second elements can be releasably interconnected to the effect that they form a hinged joint between the building elements, whereby the building elements can be mutually rotated about the common hinge axis defined at the hinged joint, wherein the toy building set further comprises at least one third building element comprising a third type of hinge part which is complementarily configured in such a way that the hinge parts on the first and third elements can be interconnected.

BACKGROUND

Today, such toy building sets are known in several embodiments wherein the elements provided with hinge parts serve to build constructions that comprise a hinge function.

Thus, the hinge parts on the known toy building sets are configured for specific purposes such as to provide the option of enabling orientation of the two building elements at any angle relative to each other. An example of this is known from GB patent application No. 2,288,551 or from WO 2012/089218 which both disclose a building system that comprises building elements that are provided with hinge parts which are suitable for hinged interconnection of two elements. Thus, the building set comprises two different hinge types that both make it possible to angle building elements at any angle relative to each other.

DK patent disclosure No. 174710 teaches another toy building set comprising building elements that are provided with hinge parts which are suitable for hinged interconnection of two elements. The building set comprises at least two different hinge types. By the toy building set it is enabled to construct, with few sub-components, both a hinged connection that can be angled at any angle, and another hinged connection that can easily be caused to occupy a number of discrete angular positions.

BRIEF DESCRIPTION OF THE INVENTION

It is the object of the present invention to provide a toy building set of the kind described above, whereby it is enabled to construct, with few sub-components, different hinge functions that provide different holding force in the hinged joint and thereby to ensure the position of the hinges at a given angle, but wherein it is still easy to interconnect two hinge parts for construction of the hinge function.

This is obtained by the subject-matter described above, by both the second type and the third type of hinge parts being provided with a toothing.

Thus, according to the invention it is obtained that, by use of a few, in principle different elements, it is possible to build both a hinged connection that may be caused to occupy a number of given discrete angular positions. It is also a further effect of this that, in a given construction in which it is desired to change a hinge structure from being securable at any angle with larger holding force, it would merely presuppose that only one of the constituent building elements with hinge parts is to by exchanged, meaning that it is easier for the user to change functions in a given toy building set.

According to an embodiment of the invention, the complementarily configured hinge parts are configured in such a way that at least one of them is/are compulsorily deformed elastically by interconnection or by separation, respectively, of the hinge parts.

According to an embodiment of the invention, the first type of hinge parts comprises two female flanges that are arranged at a mutual distance next to each other to the effect that each of the two female flanges has a substantially plane female side face facing towards the corresponding female side face on the other one of the two flanges whereby the two female flanges form a space that is delimited by the female side faces, said female side faces being essentially in parallel and are oriented at right angles to the common hinge axis.

According to an embodiment of the invention, the second and third types of hinge parts form two substantially plane and mutually parallel male side faces that are insertable between the two female side faces on the two female flanges on the first type of hinge parts, and wherein, on the female side faces of the first type of hinge parts and on the male side faces on the second type of hinge parts, complementarily configured shaft pins and shaft holes are configured that, upon interconnection of the hinge parts, define the hinge axis. Hereby it is accomplished that the abutment of the male part against the female side faces ensures that the hinged joint cannot capsize unintentionally.

According to an embodiment of the invention, the female side faces on the first type of hinge parts and the male side faces on the second and third types of hinge parts are configured with complementarily configured toothing and protrusions that engage with one another upon interconnection of the hinge parts, wherein toothing and protrusions are configured such that they engage into one another when two hinge parts are interconnected.

According to an embodiment of the invention, the female side faces comprise protrusions, and the male side faces comprise complementary toothing to the effect that protrusions and toothing can, upon interconnection of two hinge parts, engage into one another.

According to an embodiment of the invention, the toothing on the second and third types of hinge parts is constituted by a number of teeth that are located across from each male side face, which teeth are oriented towards the common hinge axis.

According to an embodiment of the invention, the third hinge part comprises a power transmission unit, wherein the third hinge part and the power transmission unit have mutual coupling studs and complementary coupling parts to the effect that the hinge part and the power transmission unit can be interconnected.

According to an embodiment of the invention, the third type of hinge parts comprises a second group of toothings, and wherein the power transmission unit comprises one or more of the second group of toothings' complementary protrusions. Hereby a ratchet function is obtained, and so is an increased holding force in a given position.

According to an embodiment of the invention, the toothing on the third type of hinge parts has teeth of a given shape and height that are arranged on the circular power transmission unit to the effect that the teeth may retain the power transmission unit in a given position.

According to an embodiment of the invention, the first group of toothings on the male-part side faces of the second and third types of hinge parts has teeth of a given shape and height; protrusions on the female flanges may engage between the teeth when two complementary hinge parts are interconnected.

According to an embodiment of the invention, the first group of toothings on the male-part side faces of the second and third types of hinge parts is configured in a circle having its centre in the common hinge axis of the two interconnected building elements.

According to an embodiment of the invention, the toothing on the second type of hinge part extends across a circular arch of more than 90° and preferably 180° or there above.

According to an embodiment of the invention, the toothing on the second type of hinge part is configured with a larger number of teeth than the toothing on the third type of hinge parts in order to thereby accomplish different discrete angle settings.

LIST OF FIGURES

An embodiment of the invention will now be explained in further detail with reference to the drawing, wherein FIG. 1 illustrates, in a perspective view, a first building element comprising a first type of hinge parts;

DETAILED DESCRIPTION REFERRING TO THE FIGURES

Figure 1:
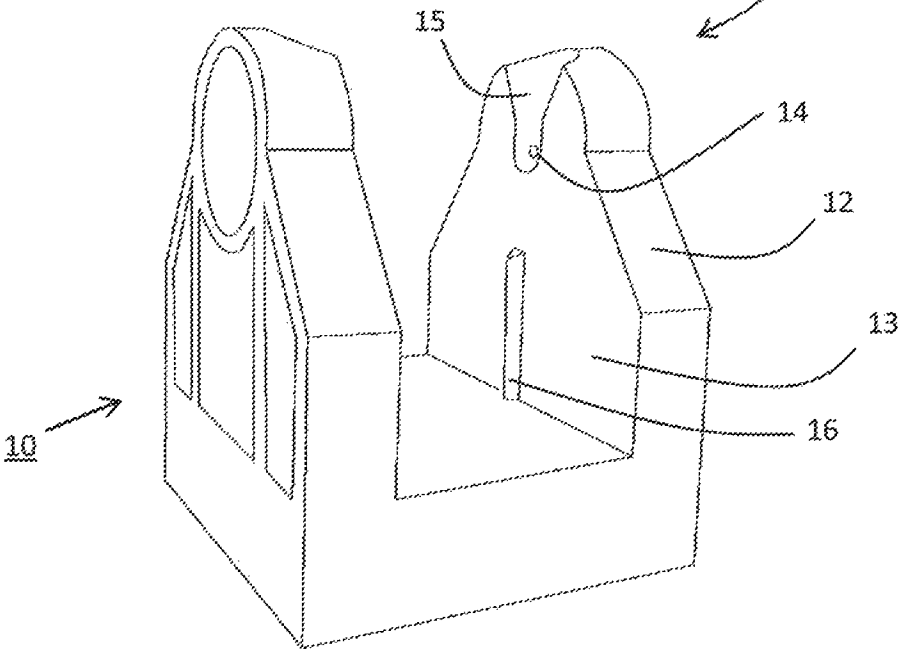

The present invention relates to a toy building set comprising a first building element 10 and a second building element 20 that can be interconnected to the effect that a hinge function is obtained. The toy building set further comprises at least one third building element 30 that can be interconnected with the first building element 10 with a view to obtaining another hinge function.

The first building element 10 has hinge parts 19 that are complementarily configured in such a way that the hinge parts 19 on the first building element and the hinge parts 29, 39 on the second/third building element 20, 30 can be interconnected in a releasable manner to the effect that they form a hinged joint between the building elements whereby the building elements can rotate mutually about the common hinge axis defined at the hinged joint.

The complementarily configured hinge parts are configured in such a way that at least one of them is compulsorily deformed elastically by interconnection or separation, respectively, of the hinge parts.

FIG. 1 shows the first type of building element 10 which is provided with a first type of hinge parts 19 comprising two elastic, substantially parallel female flanges 12 that extend at a mutual distance from the building element 10, and wherein, on each of the female flanges 12 on the side that faces towards the parallel female flange 12, a shaft hole 14 is configured.

The two female flanges 12 are arranged at a mutual distance next to each other to the effect that each of the two female flanges 12 has a substantially plane female side face 13 facing towards the corresponding female side face 13 on the other one of the two female flanges 13, whereby the two female flanges 12 form a space delimited by the female side faces 13, which female flanges 13 are substantially in parallel and are oriented at right angles to the common hinge axis.

The second and third types of hinge parts 29, 39 are constituted of a male part 21, 31 comprising a single one or two male flanges on which two male side faces 23, 33 are located in such a way that they are oriented opposite each other.

Typically, the male flanges are secured to a building element at the one end.

Figure 2:
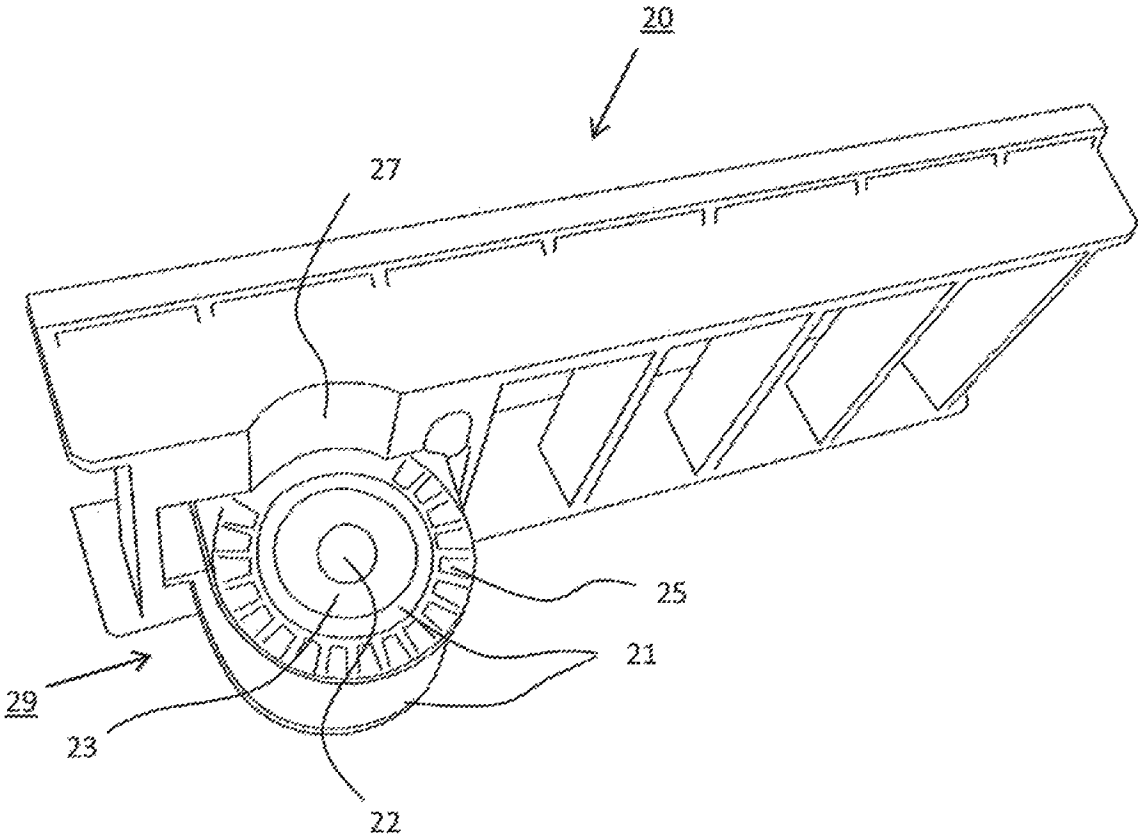
FIG. 2 illustrates, in a perspective view, a second building element comprising a second type of hinge parts.

The hinge part 29, shown in FIG. 2, on the second building element comprises a male part 21 having two parallel male side faces 23 to the effect that the male part 21 has a width allowing that the male part 21 can only just be inserted between the female flanges 12 on the building element 10 shown in FIG. 1.

By the insertion of the male part 21 between the two female flanges 12, the two female flanges are forced elastically away from each other until the shaft pins 22 on the male part 21 penetrate into the shaft hole 14 in the female flange 12 shown in FIG. 1. Thereby it is accomplished that the shaft pins 22 are capable of being rotated in the shaft hole 14, whereby a hinge function with a common hinge axis is formed.

To facilitate the introduction of the male part 21 between the two female flanges 12, guides 15 are provided on the female flanges 21 shown in FIG. 1, said guides being configured such that the shaft pins 22 can be shifted in those truncated-cone-shaped guides 15, but such that the width or depth of the guides is smaller than the largest width of the shaft pins 22 at the root of the truncated cone, and such that a certain elastic deformation of the two female flanges 12 is thereby required when the shaft pins 22 are forced through and past the guides 15 and into the shaft holes 14.

The hinge part 29 on the second building element is thus, as shown in FIG. 2, provided with a toothing 25.

The first hinge part 19 comprises an elongate protrusion 16 on each of the two female flanges 12 on the side extending transversally to the axis of the hinge part and faces towards the parallel female flange.

The second hinge part comprises complementary toothing 25 to the effect that protrusions can engage into the toothing and thereby provide a holding force to enable that the building elements are retained in a given angular position.

The toothing 25 on the second type of hinge parts 29 has teeth of a given shape and height, whereby protrusions 16 on the first hinge part 19 may engage into the teeth when the two complementary hinge parts are interconnected.

The toothing on the second type of hinge part 29 is configured in a circle having its centre in the common hinge axis, where the teeth extend such that, upon interconnection of the two hinge parts, they are capable of notching with the complementary protrusion on the female side faces.

The toothing on the second building element 20 extends across a circular arc of more than 90° and preferably 180° or there above.

Figure 3:
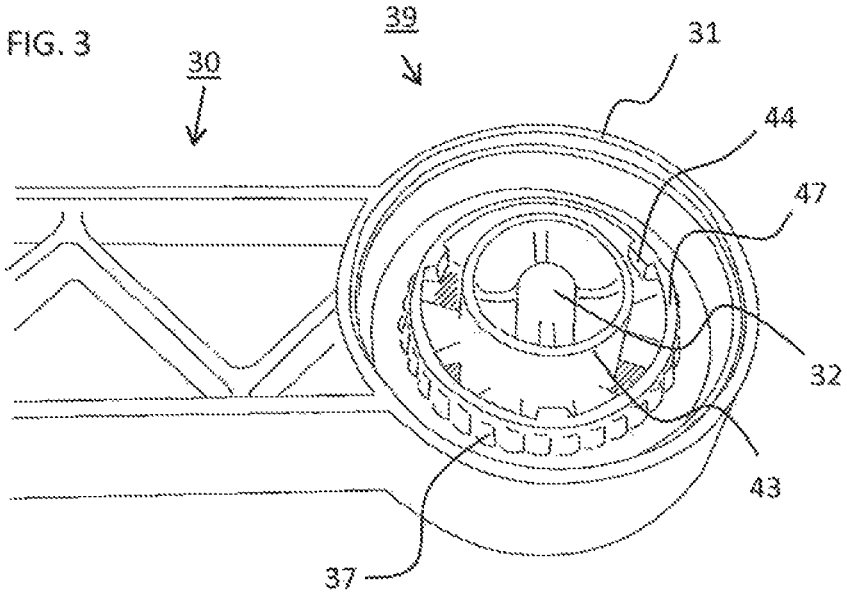
FIG. 3 illustrates, in a perspective view, a third building element comprising a third type of hinge parts without a power transmission unit.

FIG. 3 shows the third type of building elements 30 comprising a third type of hinge parts 39 that comprise two cylindrical flanges 43, 47. The first cylindrical flange 47 which is oriented coaxially with the hinge axis shared by the building elements is, on the inside of the cylindrical flange, configured with couplings studs 44 capable of engaging with a coupling part in the shape of a flange collar 45 on a power transmission unit 40. The second cylindrical flange 43 which has the smallest diameter extends past the first cylindrical flange 47 to the effect that the edge of the centrally located hole 41 on the power transmission unit 40 is capable of abutting on the outside of the flange 43.

Figure 5:
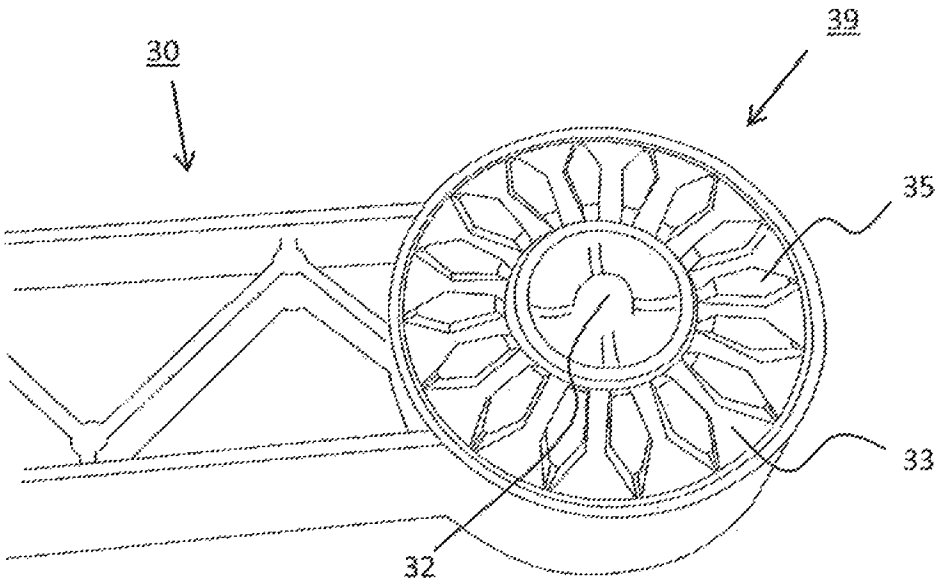
FIG. 5 illustrates the third building element interconnected with the power transmission unit.

As shown in FIG. 5, the third hinge part 39 also comprises complementarily configured toothings 35 to the effect that the protrusion from the first building element is capable of engaging into the toothing.

The toothing 25, 35 on the second and third types of hinge parts is constituted of a number of teeth that are arranged across from each male side face 23, 33, which teeth face towards the common hinge axis to the effect that the protrusion 16 on the female flanges 12 is capable of engaging with the toothing 25, 35 on one of the male parts 21, 31.

The protrusion 16 on the first element is elongate in order to thereby be able to facilitate the interconnection of the first and third building elements, the toothing 35 thus positioning itself to the effect that the elongate protrusion 15 and the toothing 35 are capable of engaging with each other while simultaneously the two hinge parts 19, 39 are interconnected.

The toothing 35 is arranged on a power transmission unit 40. The toothing 25 on the second type of hinge parts 29 is constituted by a larger number of teeth than the toothing 35 on the third type of hinge parts 39 in order to thereby obtain different discrete angle settings.

Figure 4:
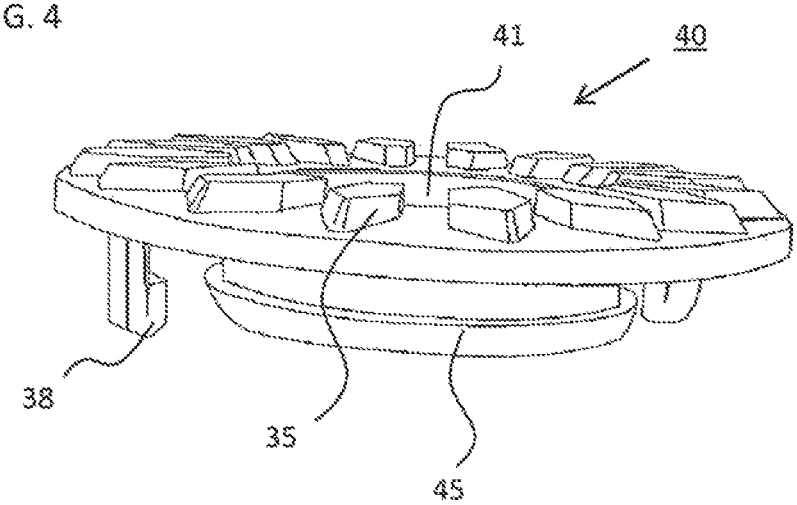
FIG. 4 illustrates, in a perspective view, a power transmission unit.

FIG. 4 shows a power transmission unit 40 configured as a disc with a centrally located hole. The hinge part 39 and the power transmission unit 40 have coupling studs 44 and complementary coupling parts 45, respectively, to the effect that the hinge part 39 and the power transmission unit 40 can be interconnected.

As shown in FIG. 3, the first group of toothing on the third type of hinge part 39 is configured in a circle having its centre in the common hinge axis, wherein the teeth extend such that, when two hinge parts are interconnected, they are capable of notching with the complementary protrusion on the female side faces.

The first group of toothing on the third type of hinge parts 39 has teeth of a given shape and height that are arranged on the power transmission unit to the effect that the teeth are capable of retaining the power transmission unit in a given position when the first and third building elements are interconnected, while the second group of toothing enables an angling of the two interconnected building elements at a mutually discrete angle.

The shape of the first type of toothing 35 is, as shown in FIG. 4, configured such that two adjacent toothings form a groove wherein each tooth has a substantially opposite, parallel abutment face to abut on the protrusion 16. Thus, a tooth comprises two abutment faces that extend away from the axis of rotation of the hinge axis. Those two abutment faces end, away from the hinge axis, in a pointed configuration. Thereby the protrusion 16 is able to more easily engage with the toothing 35. This specially configured group of teeth thus counteracts turning between the first building element and the power transmission unit.

As illustrated in FIG. 4, the power transmission unit 40 is a self-contained circular unit.

The second group of toothing 37 on the third building element on the male part 31, see FIG. 3, cooperates with complementary protrusions 38 on the power transmission unit 40 to the effect that the power transmission unit 40 and the hinge part on the third building element can be turned relative to each other, and thereby the first and third building elements can be angled relative to each other at discrete angle positions.

This second group of toothing 37 is positioned circularly about the common hinge axis where the teeth extend in parallel with the hinge axis. This second group of toothing 37 and complementary protrusions 38 may entail a ratchet effect.

The holding force for the hinge function in the discrete angle positions is defined by that second group of toothings 37.

The first group of toothing 35 on the third type of hinge parts extends all the way around in a circle with centre in the common hinge axis.

FIG. 4 shows the first group of toothing 35 on the power transmission unit 40.

The second or third toy building element 20, 30 may further comprise a hinge part corresponding to the hinge part 19 on the first building element 10. Thereby it is possible to interconnect building elements with consecutively continuous hinge functions.

The second building element is configured as a ladder, and the third building element is configured as a jib arm with a crane hook at the opposite end of the jib arm relative to the hinge part 39 of the building element. The crane hook is configured with a male part comprising shaft pins that are interconnectable with a hinge part on the jib arm which corresponds to the hinge part of the first building element where the female flanges on the jib arm are also configured with shaft holes.

By a combination of the above three building elements shown in FIGS. 1, 2, and 3, it is thus possible to form hinges having different properties, viz a joint connection allowing substantially free mutual rotation of two building elements relative to each other, and a second joint connection requiring an increased force to turn the building elements relative to each other, or facilitating angling of the two building elements into a number of discrete mutual angles.

What is claimed is:

1. A toy building set, comprising:

a first building element having a first hinge part, the first hinge part comprising two female flanges arranged at a mutual distance from one another, each of said flanges having a substantially plane female side face facing towards the corresponding female side face on the other of said flanges so as to form a space between the female side faces;

a second building element having a second hinge part, the second hinge part comprising two substantially plane and mutually parallel male side faces and a first set of toothing adapted to be inserted between said two female side faces;

at least a third building element configured to interconnect with said first building element, having a third hinge part comprising two coaxially-oriented cylindrical flanges and a flange collar, wherein one of said coaxially-oriented cylindrical flanges comprises a second set of toothing adapted to cooperate with one or more complementary protrusions on said flange collar, said flange collar also comprising a third set of toothing adapted to be inserted between said two female side faces, said third set of toothing having less teeth than said first set of toothing;

wherein said second hinge part and said third hinge part each comprises one or more integral shaft pins configured to be interconnected with one or more shaft holes on said first hinge part of said first building element to form a hinge axis;

wherein said first set of toothing on said second hinge part is configured to releasably interconnect with one or more protrusions on said first hinge part at one or more of a first set of discrete angles;

wherein said third set of toothing on said third hinge part is configured to releasably interconnect with said one or more protrusions on said first hinge part at one or more of a second set of discrete angles, said second set of discrete angles being different from said first set of discrete angles; and wherein said second set of toothing is positioned circularly around the hinge axis where the teeth of the second set of toothing extend parallel to the hinge axis such that the interconnection between the second set of toothing of the third hinge part and the one or more complementary protrusions of the third hinge part is configured to create a ratchet.

2. The toy building set according to claim 1, characterised in that the hinge parts are configured in such a way that at least one of them is compulsorily deformed elastically by interconnection or by separation, respectively, of the hinge parts.

3. The toy building set according to claim 1, wherein said female flanges of said first hinge part are essentially in parallel and are oriented at right angles to the hinge axis.

4. The toy building set according to claim 3, characterised in that the third hinge part forms two substantially plane and mutually parallel male side faces that are insertable between the two female side faces on the two female flanges of the first hinge part.

5. The toy building set according to claim 4, characterized in that the first and third sets of toothing have teeth oriented towards the hinge axis.

6. The toy building set according to claim 1, characterised in that the first set of toothing and third set of toothing each have teeth of a given shape and height that are adapted to engage with the one or more protrusions on the female flanges of said first hinge part when the hinge parts are interconnected.

7. The toy building set according to claim 1, characterised in that the first set of toothing and third set of toothing are each configured in a circle with a centre on the hinge axis of the two interconnected building elements.

8. The toy building set according to claim 1, characterised in that the first set of toothing on the second hinge part extends across a circular arch of more than 90°.

* * * * *